US010249258B2

(12) United States Patent
Park et al.

(10) Patent No.: US 10,249,258 B2
(45) Date of Patent: Apr. 2, 2019

(54) DISPLAY INTERFACE DEVICE AND DATA TRANSMISSION METHOD THEREOF

(71) Applicant: LG Display Co., Ltd., Seoul (KR)

(72) Inventors: Dong-Won Park, Goyang-si (KR); Jang-Hwan Kim, Paju-si (KR); Jong-Min Park, Anyang-si (KR); Joon-Hee Lee, Seoul (KR); Yong-Chul Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/856,900

(22) Filed: Dec. 28, 2017

(65) Prior Publication Data

US 2018/0190238 A1 Jul. 5, 2018

(30) Foreign Application Priority Data

Dec. 30, 2016 (KR) ..... 10-2016-0184083

(51) Int. Cl.

| | |
|---|---|
| ***G09G 5/00*** | (2006.01) |
| ***G09G 3/20*** | (2006.01) |
| *G09G 3/36* | (2006.01) |

(52) U.S. Cl.

CPC ..... *G09G 5/008* (2013.01); *G09G 3/2092* (2013.01); *G09G 3/2096* (2013.01); *G09G 3/3685* (2013.01); *G09G 2310/0243* (2013.01); *G09G 2310/0297* (2013.01); *G09G 2330/021* (2013.01); *G09G 2330/06* (2013.01); *G09G 2370/045* (2013.01); *G09G 2370/08* (2013.01); *G09G 2370/10* (2013.01)

(58) Field of Classification Search

CPC ..... G09G 5/008; G09G 3/2096; G09G 3/3685
USPC ..... 345/207–208
See application file for complete search history.

(56) References Cited

U.S. PATENT DOCUMENTS 8,291,206 B2 * 10/2012 Wang ..... G06F 9/4406 711/170
8,516,234 B2 * 8/2013 Kobayashi ..... G09G 5/006 713/1

* cited by examiner

*Primary Examiner* — Calvin C Ma
(74) *Attorney, Agent, or Firm* — Polsinelli PC

(57) ABSTRACT

The present disclosure relates to a display interface device which can increase display information transmission efficiency and reduce power consumption and EMI, in which a transmission part transmits clock edge information included in a data packet of each channel at a different timing from clock edge information included in data packets of other channels. A reception part detects a clock edge of each channel from the data packet transmitted through each channel, generates an internal clock signal of each channel, synchronized with the detected clock edge, corrects a delay of each channel depending on a result of a logical operation performed on a delayed clock edge of a channel and a clock edge of another channel to further generate an internal clock signal of each channel, and restores the display information from the data packet of each channel using the internal clock signal of each channel.

20 Claims, 6 Drawing Sheets

DISPLAY INTERFACE DEVICE AND DATA TRANSMISSION METHOD THEREOF

CROSS-REFERENCE TO RELATED APPLICATION

This application claims the benefit of Republic of Korea Patent Application No. 10-2016-0184083, filed on Dec. 30, 2016, which is hereby incorporated by reference in its entirety.

BACKGROUND

Field of the Disclosure

The present disclosure relates to a display device, and more particularly, to a display interface device and a data transmission method thereof which can increase display information transmission efficiency and reduce power consumption and electromagnetic interference (EMI).

Description of the Background

There are liquid crystal displays (LCDs) using liquid crystal, organic light-emitting diode (OLED) displays using OLEDs and electrophoretic displays (EPDs) using electrophoretic particles as recent display devices for displaying images using digital data.

A display device includes a panel that displays images through a pixel array, a panel driver for driving the panel, and a timing controller for controlling the panel driver. The panel driver includes a gate driver for driving gate lines of the panel and a data driver for driving data lines of the panel.

To reduce the number of transmission lines and achieve fast transmission, the timing controller and the data driver use an embedded point-to-point interface (EPI) that serializes control information and image data (pixel data), inserts clock information into the serial data to convert the serial data into packets and transmits the packets in a point-to-point manner.

Referring to FIG. 1, an EPI packet of the related art is transmitted from the timing controller to the data driver in a transmission unit of 24 bits including a 4-bit delimiter containing clock edge information, 10-bit first pixel data and 10-bit second pixel data, that is, 24 UIs (Unit Intervals). 1 UI is a 1-bit transmission time.

The data driver extracts a clock edge from the received EPI packet, generates internal clocks synchronized with the clock edge through a delay locked loop (DLL) and restores control information and pixel data from the EPI packet through sampling using the internal clocks.

However, when a length of the transmission unit of the EPI packet increases infinitely, internal clock timing cannot be adjusted because DLL synchronization becomes difficult due to a clock skew problem, resulting in data loss. Accordingly, the EPI interface of the related art has a difficulty in largely increasing the length of the packet transmission unit.

In addition, for example, each EPI packet in the transmission unit of 24 UIs further includes the 4-bit delimiter in addition to the 20-bit image data and thus requires an overhead operation of 120% (=24/20), and thus the transmission speed of the EPI increases and power consumption and EMI also increase in proportion thereto.

Furthermore, when multiple EPI packets in the transmission unit of 24 UIs are transmitted through multiple channels CH1 and CH2, as illustrated in FIG. 2, a display interface device of the related art redundantly transmits clock edge information through the multiple channels CH1 and CH2 at the same timing, resulting in transmission efficiency deterioration and EMI increase.

SUMMARY

The present disclosure provides a display interface device and a data transmission method thereof which can increase display information transmission efficiency and reduce power consumption and EMI.

In a display interface device according to an aspect, a transmission part transmits clock edge information included in a data packet of each channel at a different timing from clock edge information included in data packets of other channels. A reception part detects a clock edge of each channel from the data packet transmitted through each channel and generates an internal clock signal of each channel, synchronized with the detected clock edge, corrects a delay of each channel depending on a result of a logical operation performed on a delayed clock edge of a channel and a clock edge of another channel to further generate an internal clock signal of each channel, and restores the display information from the data packet of each channel using the internal clock signal of each channel.

In a display device according to the present disclosure, the display device comprising a data driver having a plurality of data ICs and a timing controller connected with the data driver through a plurality of channels includes a transmission part disposed at the timing controller, serializing image data of pixels of the display device, converting the image data with a clock signal into a plurality of embedded point-to-point interface (EPI) packets and distributing the EPI packets to the plurality of channels as a transmission unit, wherein the transmission part transmits clock edge information included in a data packet of each channel at a different timing from clock edge information included in data packets of other channels; and a reception part disposed at each data driving IC, connected through the plurality of channels with the transmission part, receiving the EPI packets from the transmission part as a differential signal, generating a delay-compensated internal clock signal of each channel and restoring the image data from a data packet of each channel using the delay-compensated internal clock signal of each channel.

The data packet may be an EPI packet including a delimiter containing the clock edge information and a plurality of pieces of pixel data in the transmission unit.

Clock edge information of an EPI packet transmitted through each of the plurality of channels from the transmission part may have a reference time difference less than the transmission unit from clock edge information of an EPI packet transmitted through a neighboring channel.

The reception part may receive the plurality of EPI packets through first and second channels and, when generating internal clock signals of the first and second channels, detects a clock edge from the EPI packet of each channel, delay the clock edge by the reference time difference through a delay, perform an XOR operation on the delayed clock edge of each channel and a clock edge of another channel detected from the EPI packet of the other channel to generate a clock skew signal of each channel, and generate a delay-compensated internal clock signal of each channel using the clock skew signal of each channel. The EPI packet in the transmission unit may have 44 UIs (unit intervals) including 4-bit delimiter containing the clock edge information and 40-bit first to fourth pieces of pixel data, and the reference time difference has 22 UIs.

The reception part may receive the plurality of EPI packets through first to fourth channels and, when generating an internal clock signals of the first channel, detect a clock edge of each channel from the EPI packet of each of the first to fourth channels, delay the clock edge of the first channel by the reference time difference through a first delay, delay the clock edge of the second channel by the reference time difference through a second delay, delay the clock edge of the third channel by the reference time difference through a third delay, perform an XOR operation on the clock edge of the fourth channel and the first to third clock edges delayed through the first to third delays to generate a clock skew signal of the first channel, and generate a delay-compensated internal clock signal of the first channel using the clock skew signal of the first channel. The EPI packet in the transmission unit may have 84 UIs including 4-bit delimiter containing the clock edge information and first to 80-bit eighth pieces of pixel data, and the reference time difference has 21 UIs.

The display interface device according to an aspect can transmit a clock edge using multiple channels at different timings, generate internal clocks of each channel using the clock edge of each channel, and generate delay-compensated internal clocks of each channel using a combination of the clock edge of a neighboring channel and a delayed clock edge of the corresponding channel.

Accordingly, it is possible to increase the number of UIs of a transmission unit per EPI packet, which can be provided through each channel, without data loss to improve transmission efficiency, to decrease power consumption according to overhead reduction and to reduce EMI according to clock edge timing distribution in multiple channels.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Reference will now be made in detail to the aspects of the present disclosure, examples of which are illustrated in the accompanying drawings. Wherever possible, the same reference numbers will be used throughout the drawings to refer to the same or like parts.

Figure 1:
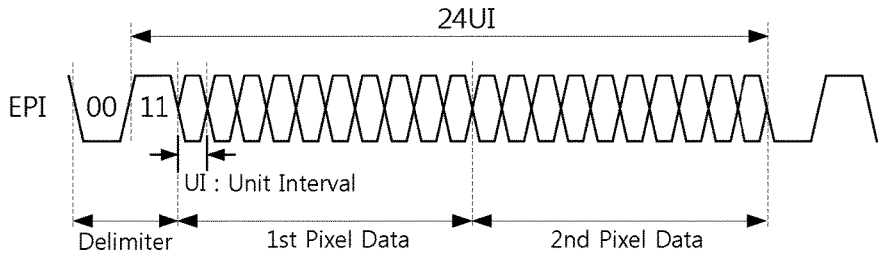
FIG. 1 Related Art
FIG. 1 illustrates an example of a configuration of an EPI packet of the related art.
Figure 2:
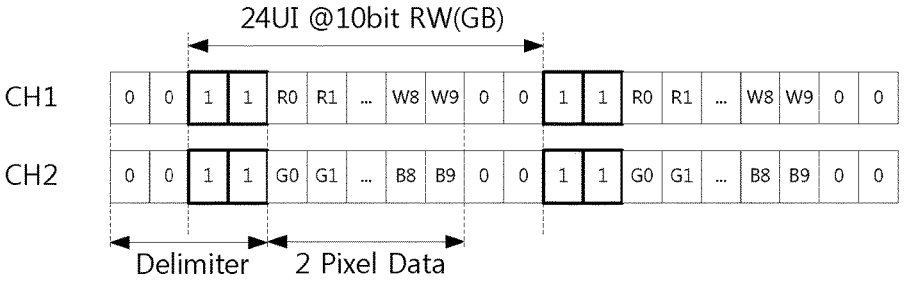
FIG. 2 Related Art
FIG. 2 illustrates a data transmission method using multiple channels in a display interface device of the related art.
Figure 3:
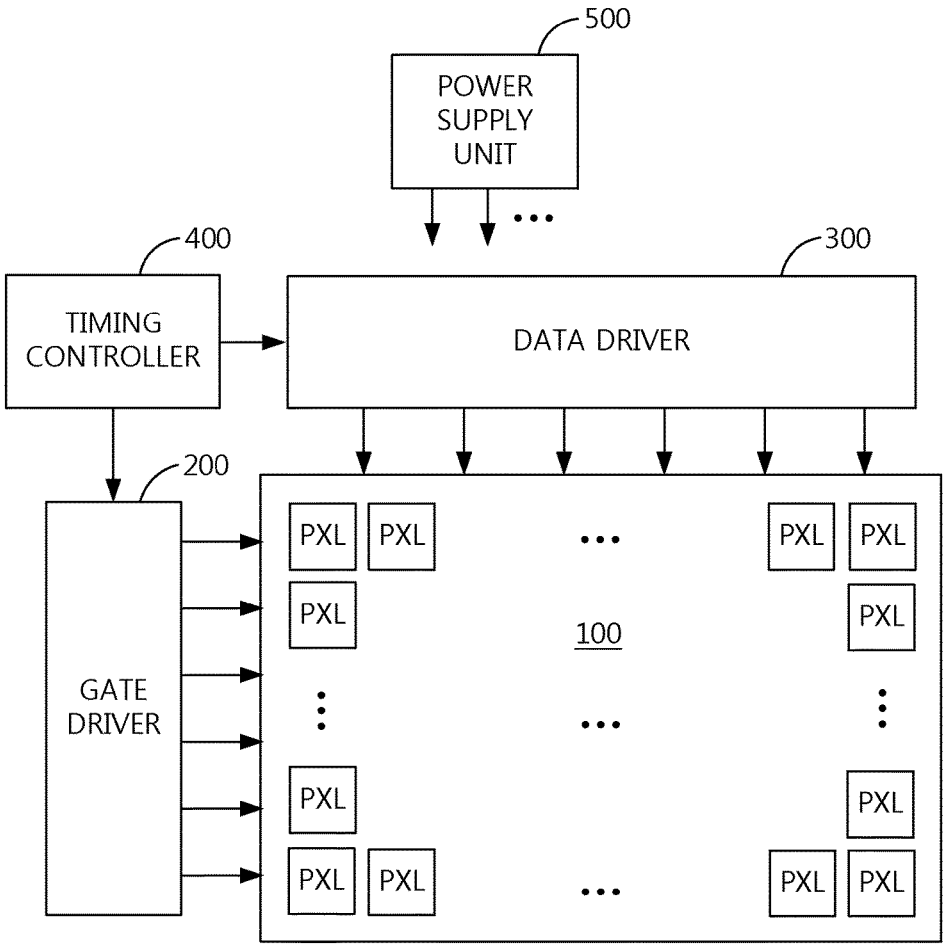
FIG. 3 is a block diagram schematically illustrating a configuration of a display device according to an aspect of the present disclosure.
Figure 4:
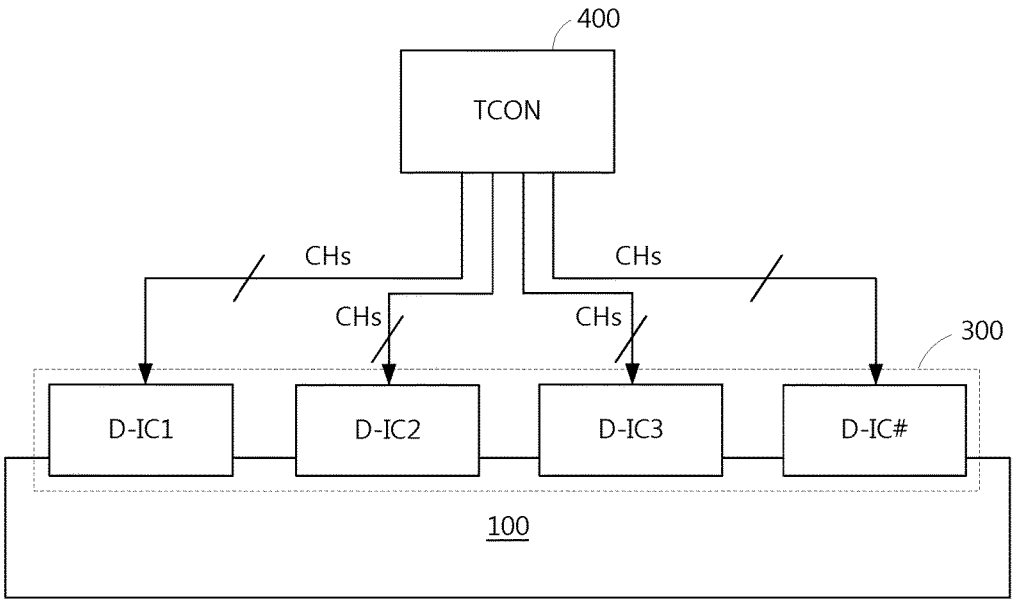
FIG. 4 illustrates a connection structure of a timing controller and multiple data driving ICs according to an aspect of the present disclosure.

FIG. 3 is a block diagram schematically illustrating a configuration of a display device according to an aspect of the present disclosure and FIG. 4 illustrates a connection structure of a timing controller and multiple data driving ICs in a display device according to an aspect of the present disclosure.

Referring to FIG. 3, the display device includes a panel 100, a gate driver 200, a data driver 300, a timing controller (TCON) 400 and a power supply unit 500.

The panel 100 displays images through a pixel array in which pixels PXL are arranged in a matrix form. The unit pixel of the pixel array may be composed of at least three subpixels W/R/G, B/W/R, G/B/W, R/G/B or W/R/G/B which can express white through color combinations among white (W), red (R), green (G) and blue (B) subpixels.

The panel 100 may be various display panels such as an OLED panel and a liquid crystal display panel, or may be a display panel with a touch sensing function.

The power supply unit 500 generates and supplies various driving voltages necessary for the display device. The power supply unit 500 generates various driving voltages necessary to drive various circuit components, that is, the timing controller 400, the gate driver 200, the data driver 300 and the panel 100 using an external input voltage and outputs the driving voltages.

The gate driver 200 generates scan pulses using a gate control signal supplied from the timing controller 400 and sequentially drives gate lines. The gate driver 200 supplies scan pulses of a gate on voltage to a gate line during a corresponding scan period and supplies a gate off voltage to the gate line during the remaining period in which other gate lines are driven.

The gate driver 200 includes at least one gate IC and is mounted on a circuit film such as a TCP (Tape Carrier Package), a COF (Chip On Film) and an FPC (Flexible Printed Circuit) to be attached to the panel 100 through TAB (Tape Automated Bonding) or mounted on the panel 100 using COG (Chip On Glass). Alternatively, the gate driver 200 may be configured as a GIP (Gate In Panel) type embedded in a non-display area of the panel 100 by being formed on a thin film transistor substrate together with thin film transistors constituting the pixel array of the panel 100.

The timing controller 400 receives image data and timing signals from a host system (not shown). The timing signals include a dot clock signal, a data enable signal, a vertical synchronization signal and a horizontal synchronization signal. The vertical synchronization signal and the horizontal synchronization signal can be generated by counting the data enable signal and thus may be omitted.

The timing controller 400 generates gate control signals for controlling driving timing of the gate driver 200 using the timing signals supplied from the host system and supplies the gate control signals to the gate driver 200. For example, the gate control signals include a gate start pulse signal for controlling a scan operation of a shift register, a gate shift clock signal, a gate output enable signal for controlling output timing of a scan pulse, etc.

The timing controller 400 generates data control signals for controlling driving timing of the data driver 300 using the timing signals supplied from the host system and supplies the data control signals to the data driver 300. For example, the data control signals include a source start pulse signal used to control data latch timing, a source sampling clock signal, and a source output enable signal for controlling data output timing. The timing controller 400 performs various image processes for picture quality compensation or power consumption reduction on image data supplied from the host system and outputs the processed image data to the data driver 300.

The data driver 300 is controlled by a data control signal supplied from the timing controller 400, converts image data supplied from the timing controller into an analog data signal and provides the analog data signal to data lines of the panel 100. The data driver 300 divides a reference gamma voltage set supplied from a gamma voltage generator (not shown) included therein or externally provided into grayscale voltages corresponding to grayscale values of data, converts digital image data into an analog data signal using the divided grayscale voltages and supplies the analog data signal to each data line of the panel 100.

The timing controller 400 and the data driver 300 transmit and receive data using an EPI interface.

The timing controller 400 converts display information including image data and data control signals into serial EPI packets including clock edge information using an EPI protocol and transmits the EPI packets to the data driver 300 through multiple channels.

The EPI packet includes a control packet containing a clock signal and control information in a serial form, a data packet containing a clock signal and RGB or WRGB data in a serial form, and the like, and further includes a clock training pattern for internal clock locking of a DLL in the data driver 300.

Particularly, the timing controller 400 can temporally disperse clock edges such that clock edge timings do not match in multiple channels and transmit multiple EPI packets to reduce EMI. The data driver 300 detects a clock edge of each channel from an EPI packet transmitted through each channel and generates an internal clock signal synchronized with the clock edge through a DLL. In addition, the data driver 300 corrects a DLL delay according to a clock skew signal obtained by logically combining a delayed clock edge of a channel and a clock edge of another channel to generate the internal clock signal. The data driver 300 restores display information transmitted through the EPI packet of each channel using the internal clock signal of each channel generated in this manner and uses the display information.

Referring to FIG. 4, the data driver 300 includes a plurality of data ICs D-IC1 to D-IC#. The data ICs are individually connected to the timing controller (TCON) 400 through a plurality of channels CHs.

Figure 5:
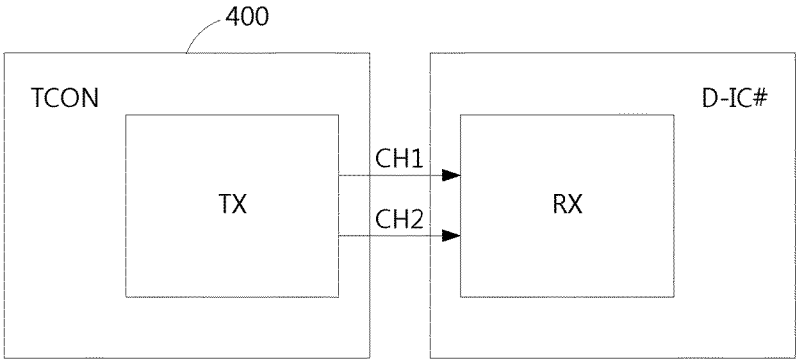
FIG. 5 is a block diagram schematically illustrating a configuration of a display interface device according to an aspect of the present disclosure.
Figure 6:
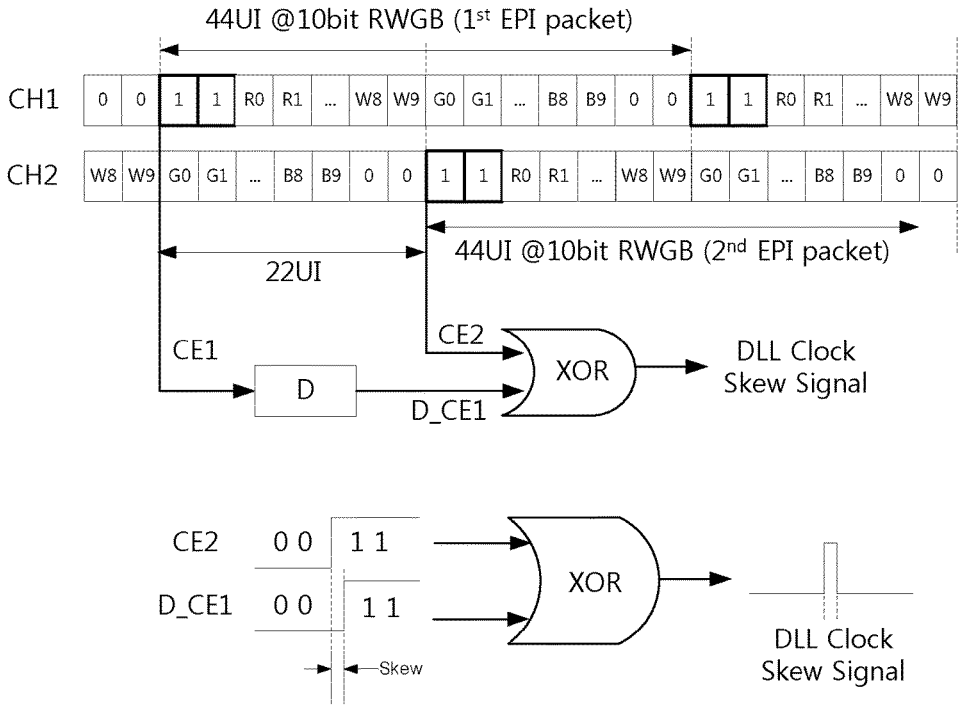
FIG. 6 illustrates a data transmission method of the display interface device according to an aspect of the present disclosure.

FIG. 5 is a block diagram schematically illustrating a configuration of a display interface device according to an aspect of the present disclosure and FIG. 6 illustrates a data transmission method and a clock recovery method of the display interface device according to an aspect of the present disclosure.

Referring to FIG. 5, the display interface device according to an aspect of the present disclosure includes a transmission part TX configured at the output terminal of the timing controller 400, a reception part RX configured at the input terminal of each data driving IC D-IC#, and first and second channels CH1 and CH2 connected between the transmission part TX and the reception part RX. The first channel CH1 includes a first interconnection line pair which carries an EPI packet in a differential signal form and the second channel CH2 includes a second interconnection line pair. The transmission part TX and the reception part RX can transmit EPI packets to the two channels CH1 and CH2 through the first and second interconnection line pairs.

The transmission unit TX serializes image data of pixels, inserts a clock signal generated from a phase locked loop (PLL) between pieces of image data of pixels to convert the image data into an EPI packet, and distributes multiple EPI packets to the multiple channels CH1 and CH2. The transmission part TX converts the multiple EPI packets distributed to the multiple channels CH1 and CH2 into differential signals and transmits the differential signals to the reception part RX of each data driving IC D-IC# through the channels CH1 and CH2.

Particularly, the transmission part TX temporally disperses clock edges of a first EPI packet distributed to the first channel CH1 and a second EPI packet distributed to the second channel CH2, as illustrated in FIG. 6, and transmits the first and second EPI packets.

The reception part RX of the data driving IC D-IC# detects the clock edge of each channel from the EPI packets transmitted over the multiple channels CH1 and CH2, corrects a DLL delay of each channel according to the detected clock edge and generates an internal clock signal synchronized with the clock edge and having a period of 2 UIs. The reception part RX generates the internal clock signal by correcting the DLL delay of each channel according to a clock skew signal detected by logically combining a delayed clock edge of a channel and a clock edge of another channel. The reception part RX restores display information from the EPI packet of each channel through sampling using the internal clock signal of each channel.

Referring to FIG. 6, the transmission part TX transmits an EPI packet in transmission units of 44 UIs including 40-bit image data of each basic pixel which includes 10-bit R pixel data [R0: R9], 10-bit W pixel data [W0: W9], 10-bit G pixel data [G0: G9] and 10-bit B pixel data [B0: B9] and a 4-bit delimiter indicating a clock edge (rising edge) through each of the channels CH1 and CH2. Particularly, the transmission part TX temporally disperses timings of a clock edge CE1 of the first channel CH1 and a clock edge CE2 of the second channel CH2 without overlapping each other and transmits the EPI packet.

For example, when each EPI packet in the 44-UI transmission unit is transmitted through each channel, as illustrated in FIG. 6, the first EPI packet and the second EPI packet can be transmitted through the first and second channels CH1 and CH2 having an interval of 22 UIs corresponding to half the 44-UI transmission unit between the clock edge CE1 of the first EPI packet and the clock edge CE2 of the second EPI packet.

The reception part RX detects the clock edge CE1 of the first channel CH1 from the first EPI packet transmitted through the first channel CH1 and corrects a DLL delay of the first channel according to the detected clock edge CE1 to generate an internal clock signal for the first channel.

The reception part RX delays the detected clock edge CE1 of the first channel by predetermined 22 UIs through a delay D and detects the clock edge CE2 of the second channel CH2 from the second EPI packet transmitted through the second channel CH2. A delay amount of the delay D is set to 22 UIs corresponding to a time difference between the first and second clock edges CE1 and CE2.

The reception part RX generates a DLL clock skew signal of the first channel, which corresponds to a time difference between the clock edge CE2 of the second channel and the delayed clock edge D_CE1 of the first channel, by performing an XOR operation on the clock edge CE2 of the second channel and the delayed clock edge D_CE1 of the first channel using an exclusive OR (XOR) operator, and corrects the DLL delay of the first channel using the generated DLL clock skew signal of the first channel to generate the internal clock signal for the first channel.

In the same manner, the reception part RX generates an internal clock signal for the second channel through a DLL for the second channel using the clock edge CE2 of the second channel CH2, which is detected from the second EPI packet of the second channel CH2, and a DLL clock skew signal of the second channel, which is generated by performing an XOR operation on the clock edge CE1 of the first channel CH1 and a delayed clock edge D_CE2 of the second channel.

The reception part RX restores RWGB data of the first basic pixel from the first EPI packet transmitted through the first channel CH1 using the internal clock signal for the first channel and restores RWGB data of the second basic pixel from the second EPI packet transmitted through the second channel CH2 using the internal clock signal for the second channel.

Accordingly, the display interface device according to an aspect can prevent data loss while increasing an EPI packet transmission unit, transmit R/W/G/B pixel data per EPI packet to improve transmission efficiency, reduce overhead to 110% (=44/40) to decrease power consumption in proportion thereto, and decrease EMI through temporal dispersion of clock edges in multiple channels CH1 and CH2.

Figure 7:
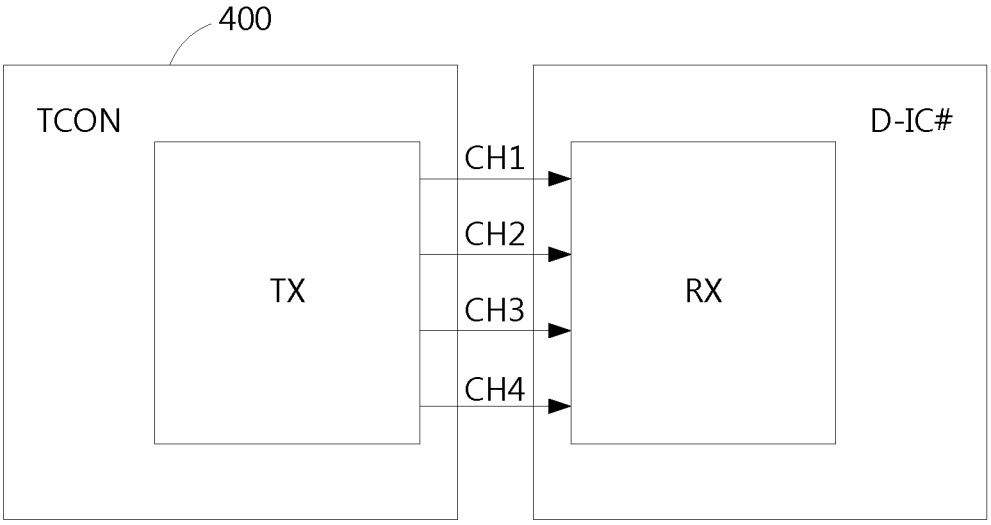
FIG. 7 is a block diagram schematically illustrating a configuration of a display interface device according to another aspect of the present disclosure.
Figure 8:
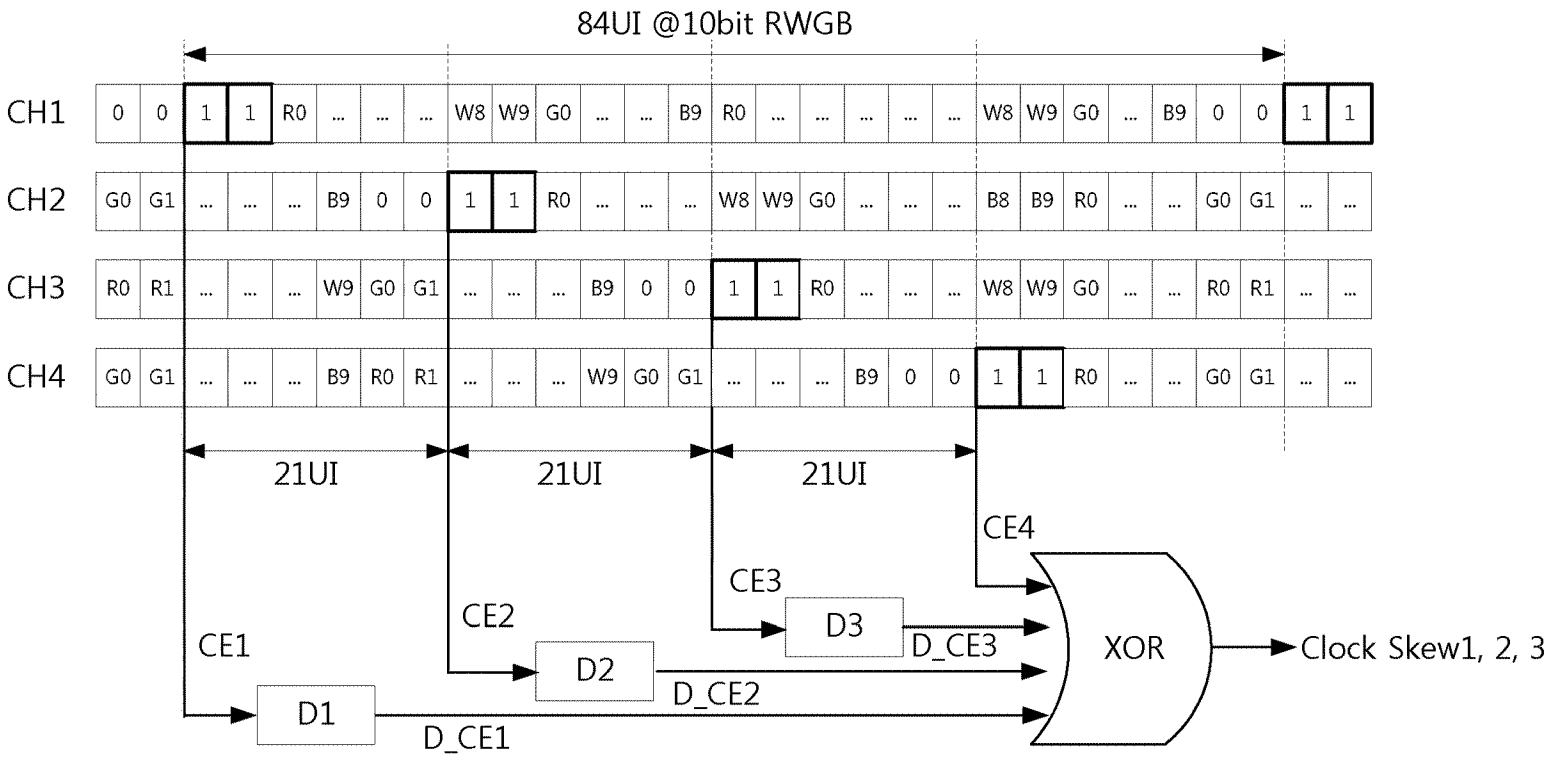
FIG. 8 illustrates a data transmission method of the display interface device according to another aspect of the present disclosure.

FIG. 7 is a block diagram schematically illustrating a configuration of a display interface device according to another aspect of the present disclosure and FIG. 8 illustrates a data transmission method and a clock recovery method of the display interface device according to another aspect of the present disclosure.

Referring to FIG. 7, the transmission part TX of the timing controller 400 and the reception part RX of each data driving IC D-IC# can transmit multiple EPI packets through first to fourth channels CH1, CH2, CH3 and CH4 as illustrated in FIG. 8.

Referring to FIG. 8, the transmission part TX transmits each EPI packet in transmission units of 84 UIs including 40-bit RWGB data of the first basic pixel, 40-bit RWGB data of the second basic pixel and a 4-bit delimiter indicating a clock edge (i.e., rising edge) through each of the four channels CH1, CH2, CH3 and CH4. The transmission part RX temporally disperses timings of clock edges CE1, CE2, CE3 and CE4 of the four channels CH1, CH2, CH3 and CH4 without overlap and transmits EPI packets through the channels.

For example, the EPI packets in 84-UI transmission units can be transmitted through the channels having an interval corresponding to 21 UIs between neighboring clock edges CE1, CE2, CE3 and CE4 of the four channels CH1, CH2, CH3 and CH4, as illustrated in FIG. 8.

The reception part RX detects the clock edge CE1 from the EPI packet of the first channel CH1 and generates an internal clock signal for the first channel. The reception part RX detects the clock edge CE2 of the second channel from the EPI packet of the second channel CH2, detects the clock edge CE3 of the third channel from the EPI packet of the third channel CH3, and detects the clock edge CE4 of the fourth channel from the EPI packet of the fourth channel CH4.

The reception part RX delays the clock edge CE1 of the first channel by predetermined 21 UIs through a delay D1, delays the clock edge CE2 of the second channel by 21 UIs through a delay D2, and delays the clock edge CE3 of the third channel by 21 UIs through a delay D3. Delay amounts of the first to third delays D1, D2 and D3 are set to 21 UIs corresponding to a time difference between neighboring clock edges CE1, CE2, CE3 and CE4.

The reception part RX performs an XOR operation on delayed clock edges D_CE1, D_CE2 and D_CE3 of the first to third channels and the clock edge CE4 of the fourth channel using an exclusive OR (XOR) operator to sequentially generate a DLL clock skew signal of the first channel whenever the clock edges CE2, CE3 and CE4 of the second to fourth channels CH2, CH3 and CH3 are detected, and corrects a DLL delay for the first channel using the generated DLL clock skew signal of the first channel to generate an internal clock signal for the first channel.

In a similar manner, the reception part RX generates internal clock signals for the second to fourth channels.

The reception part RX restores the RWGB data of the first basic pixel from the first EPI packet transmitted through the first channel CH1 using the internal clock signal for the first channel and restores the RWGB data of the second basic pixel from the second EPI packet transmitted through the second channel CH2 using the internal clock signal for the second channel.

Accordingly, the display interface device according to an aspect can prevent data loss while increasing an EPI packet transmission unit, transmit R/W/G/B pixel data of two basic pixels per EPI packet to improve transmission efficiency, reduce overhead to 105% (=84/80) to decrease power consumption in proportion thereto, and decrease EMI through temporal dispersion of clock edges in multiple channels CH1, CH2, CH3 and CH4.

The foregoing description of illustrated aspects of the present disclosure, including what is described in the abstract, is not intended to be exhaustive or to limit the disclosure to the precise forms disclosed herein. While specific aspects and examples of the disclosure are described herein for illustrative purposes only, various equivalent modifications are possible within the spirit and scope of the present disclosure, as those skilled in the relevant art will recognize and appreciate. As indicated, these modifications may be made to the present disclosure in light of the foregoing description of illustrated aspects of the present disclosure and are within the spirit and scope of the present disclosure.

What is claimed is:

1. A display interface device comprising:

a transmission part and a reception part, wherein the transmission part serializes clock edge information and display information and distributes a plurality of data packets each including serial clock edge information and display information as a transmission unit to a plurality of channels, and the reception part receives the plurality of data packets from the transmission part, wherein the transmission part transmits clock edge information included in a data packet of each channel at a different timing from clock edge information included in data packets of other channels, and the reception part detects a clock edge of each channel from the data packet transmitted through each channel and generates an internal clock signal of each channel, synchronized with the detected clock edge, corrects a delay of each channel depending on a result of a logical operation performed on a delayed clock edge of a channel and a clock edge of another channel to generate a delay-compensated internal clock signal of each channel, and restores the display information from the data packet of each channel using the internal clock signal of each channel.

2. The display interface device according to claim 1, wherein the plurality of data packet includes an embedded point-to-point interface (EPI) packet comprising a delimiter having the clock edge information and a plurality of pieces of pixel data in the transmission unit.

3. The display interface device according to claim 2, wherein the clock edge information of one data packet transmitted through each of the plurality of channels from the transmission part has a reference time difference less than the transmission unit from clock edge information of another data packet transmitted through a neighboring channel.

4. The display interface device according to claim 3, wherein the reception part:

receives the plurality of data packets through first and second channels, detects a clock edge from the data packet of each channel, and delays the clock edge by the reference time difference through a delay when the internal clock signals of the first and second channels are generated, performs an logic operation on the delayed clock edge of each channel and a clock edge of another channel detected from the data packet of the other channel to generate a clock skew signal of each channel, and generates the delay-compensated internal clock signal of each channel using the clock skew signal of each channel.

5. The display interface device according to claim 4, wherein the data packet in the transmission unit has 44 UIs (unit intervals) including 4-bit delimiter containing the clock edge information and 40-bit first to fourth pieces of pixel data, and the reference time difference has 22 UIs.

6. The display interface device according to claim 3, wherein the reception part:

receives the plurality of data packets through first to fourth channels, detects a clock edge of each channel from the EPI packet of each of the first to fourth channels when the internal clock signals of the first channel are generated, delays the clock edge of the first channel by the reference time difference through a first delay, delays the clock edge of the second channel by the reference time difference through a second delay, delays the clock edge of the third channel by the reference time difference through a third delay, performs a logic operation on the clock edge of the fourth channel and the first to third clock edges delayed through the first to third delays to generate a clock skew signal of the first channel, and generates the delay-compensated internal clock signal of the first channel using the clock skew signal of the first channel.

7. The display interface device according to claim 6, wherein the data packet in the transmission unit has 84 UIs including 4-bit delimiter having the clock edge information and 80-bit first to eighth pieces of pixel data, and the reference time difference has 21 UIs.

8. A data transmission method of a display interface device, comprising:

serializing clock edge information and display information of image data of each pixel;

distributing a plurality of data packets each including the serial clock edge information and the display information as a transmission unit to a plurality of channels;

transmitting the clock edge information included in a data packet of each channel at a different timing from the clock edge information included in data packets of other channels;

detecting a clock edge of each channel from the data packet transmitted through each channel and generating an internal clock signal of each channel, synchronized with the detected clock edge;

correcting a delay of each channel depending on a result of a logical operation performed on a delayed clock edge of a channel and a clock edge of another channel to generate a delay-compensated internal clock signal of each channel; and restoring the display information from the data packet of each channel using the delay-compensated internal clock signal of each channel.

9. The data transmission method according to claim 8, wherein each data packet in the transmission unit has 44 UIs (unit intervals) including 4-bit delimiter having the clock edge information and 40-bit first to fourth pieces of pixel data.

10. The data transmission method according to claim 8, wherein each data packet in the transmission unit has 84 UIs including 4-bit delimiter having the clock edge information and 80-bit first to eighth pieces of pixel data.

11. A display device comprising a data driver having a plurality of data ICs and a timing controller connected with the data driver through a plurality of channels, comprising:

a transmission part disposed at the timing controller, serializing image data of pixels of the display device, converting the image data with a clock signal into a plurality of embedded point-to-point interface (EPI) packets and distributing the EPI packets to the plurality of channels as a transmission unit, wherein the transmission part transmits clock edge information included in a data packet of each channel at a different timing from clock edge information included in data packets of other channels; and a reception part disposed at each data driving IC, connected through the plurality of channels with the transmission part, receiving the EPI packets from the transmission part as a differential signal form, generating a delay-compensated internal clock signal of each channel and restoring the image data from a data packet of each channel using the delay-compensated internal clock signal of each channel.

12. The display device according to claim 11, wherein the reception part generates the delay-compensated internal clock signal by detecting a clock edge of each channel from the data packet transmitted through each channel, generating an internal clock signal of each channel, synchronized with the detected clock edge and correcting a delay of each channel depending on a result of a logical operation performed on a delayed clock edge of a channel and a clock edge of another channel.

13. The display device according to claim 11, wherein a clock signal generated from a phase locked loop (PLL) is inserted between the image data prior to converting to the EPI packets.

14. The display device according to claim 11, wherein the plurality of EPI packets includes a delimiter having the clock edge information and the image data in the transmission unit.

15. The display device according to claim 14, wherein the clock edge information of one data packet transmitted through each of the plurality of channels from the transmission part has a reference time difference less than the transmission unit from clock edge information of another data packet transmitted through a neighboring channel.

16. The display device according to claim 15, wherein the reception part:

receives the plurality of EPI packets through first and second channels, detects a clock edge from the data packet of each channel, and delays the clock edge by the reference time difference through a delay when the internal clock signals of the first and second channels are generated, performs an logic operation on the delayed clock edge of each channel and a clock edge of another channel detected from the data packet of the other channel to generate a clock skew signal of each channel, and generates the delay-compensated internal clock signal of each channel using the clock skew signal of each channel.

17. The display device according to claim 16, wherein the first channel includes a first interconnection line pair carrying an EPI packet in the differential signal form and the second channel includes a second interconnection line pair.

18. The display device according to claim 16, wherein each data packet in the transmission unit has 44 UIs (unit intervals) including 4-bit delimiter containing the clock edge information and 40-bit first to fourth pieces of pixel data, and the reference time difference has 22 UIs.

19. The display device according to claim 15, wherein the reception part:

receives the plurality of EPI packets through first to fourth channels, detects a clock edge of each channel from the EPI packet of each of the first to fourth channels when the internal clock signals of the first channel are generated, delays the clock edge of the first channel by the reference time difference through a first delay, delays the clock edge of the second channel by the reference time difference through a second delay, delays the clock edge of the third channel by the reference time difference through a third delay, performs a logic operation on the clock edge of the fourth channel and the first to third clock edges delayed through the first to third delays to generate a clock skew signal of the first channel, and generates the delay-compensated internal clock signal of the first channel using the clock skew signal of the first channel.

20. The display device according to claim 19, wherein the data packet in the transmission unit has 84 UIs including 4-bit delimiter having the clock edge information and 80-bit first to eighth pieces of pixel data, and the reference time difference has 21 UIs.

* * * * *